US010973349B2

(12) United States Patent
Darlow et al.

(10) Patent No.: US 10,973,349 B2
(45) Date of Patent: Apr. 13, 2021

(54) VACUUM DECORATION OF A DRINKING OR EATING VESSEL

(71) Applicant: AT Promotions, LTD., King's Lynn (GB)

(72) Inventors: Gary Darlow, King's Lynn (GB); Alexander Edward Turner, Great Massingham (GB)

(73) Assignee: AT Promotions, LTD, Kings Lynn (GB)

( * ) Notice: Subject to any disclaimer, the term of this patent is extended or adjusted under 35 U.S.C. 154(b) by 0 days.

(21) Appl. No.: 16/477,161

(22) PCT Filed: Jan. 10, 2018

(86) PCT No.: PCT/GB2018/050056
§ 371 (c)(1),
(2) Date: Jul. 10, 2019

(87) PCT Pub. No.: WO2018/130823
PCT Pub. Date: Jul. 19, 2018

(65) Prior Publication Data

US 2019/0343309 A1 Nov. 14, 2019

(30) Foreign Application Priority Data

Jan. 10, 2017 (GB) ..... 1700408

(51) Int. Cl.
*B41F 16/00* (2006.01)
*B41M 5/035* (2006.01)
(Continued)

(52) U.S. Cl.
CPC ..... *A47G 19/2227* (2013.01); *B41F 16/0086* (2013.01); *B41F 17/002* (2013.01);
(Continued)

(58) Field of Classification Search
CPC .. B41M 5/0256; B41M 5/0358; B41M 5/035; B41M 5/0355; B41M 5/0356; B41F 16/00; B41F 16/0086; B41P 2217/61
See application file for complete search history.

(56) References Cited

U.S. PATENT DOCUMENTS 4,943,684 A 7/1990 Kramer
4,966,815 A 10/1990 Hare
(Continued)

FOREIGN PATENT DOCUMENTS

CN 201612433 8/2001
CN 101305884 11/2008
(Continued)

OTHER PUBLICATIONS

US 10,189,606 B2, 01/2019, Turner (withdrawn)
(Continued)

*Primary Examiner* — Leslie J Evanisko
(74) *Attorney, Agent, or Firm* — Evan Law Group LLC

(57) ABSTRACT

The present invention relates to a method for decorating a drinking or eating vessel, the method comprising: a. providing: i. a drinking or eating vessel, wherein the vessel comprises an inner surface that defines a volume for receiving a liquid or a solid food and an outer surface comprising a polymeric coating; and ii. a transfer sheet, wherein the transfer sheet comprises a printed decoration; and iii. a supporting means comprising a recess for receiving the vessel; and b. arranging the vessel within the recess of the supporting means thereby defining a lower portion of the outer surface of the vessel occluded from contact with the transfer sheet and an upper portion of the outer surface of the vessel for contacting the transfer sheet; and contacting the upper portion of the outer surface of the vessel and the supporting means with the transfer sheet under at least a partial vacuum, wherein the printed decoration is transferred
(Continued)

from the transfer sheet to the upper portion of the outer surface of the vessel, and wherein the supporting means reduces stretching of the transfer sheet from the upper portion of the outer surface of the vessel to the lower portion of the outer surface of the vessel. Also described are associated uses, an apparatus, and drinking or eating vessels obtainable by the methods of the invention.

20 Claims, 7 Drawing Sheets

(51) Int. Cl.

| | |
|---|---|
| ***A47G 19/22*** | (2006.01) |
| ***B41F 17/00*** | (2006.01) |
| ***B41F 17/18*** | (2006.01) |
| ***B41F 17/20*** | (2006.01) |
| ***B41F 17/28*** | (2006.01) |
| ***B41M 5/025*** | (2006.01) |
| *A47G 19/02* | (2006.01) |

(52) U.S. Cl.
CPC ..... *B41F 17/18* (2013.01); *B41F 17/20* (2013.01); *B41F 17/28* (2013.01); *B41M 5/0256* (2013.01); *B41M 5/0358* (2013.01); *A47G 19/025* (2013.01); *B41P 2217/61* (2013.01); *B41P 2217/62* (2013.01)

(56) References Cited

U.S. PATENT DOCUMENTS

| | | | |
|---|---|---|---|
| 4,989,508 | A | 2/1991 | King |
| 4,993,987 | A | 2/1991 | Hull et al. |
| 5,246,518 | A | 9/1993 | Hale |
| 5,286,706 | A | 2/1994 | Mochizuki et al. |
| 5,330,962 | A | 7/1994 | De Barbandere et al. |
| 5,643,387 | A | 7/1997 | Berghauser et al. |
| 5,944,931 | A * | 8/1999 | Cranford ..... B44C 1/1716 156/230 |
| 5,997,678 | A | 12/1999 | Wess et al. |
| 6,217,694 | B1 | 4/2001 | Taniguchi |
| 8,274,537 | B2 * | 9/2012 | Howell ..... B41F 16/00 347/186 |
| 9,856,055 | B2 | 1/2018 | Turner |
| 10,125,270 | B2 | 11/2018 | Turner |
| 10,273,055 | B2 | 4/2019 | Turner |
| 2005/0191569 | A1 | 9/2005 | Aylward et al. |
| 2007/0048466 | A1 | 3/2007 | Huynh |
| 2007/0141125 | A1 | 6/2007 | Bourdelais et al. |
| 2011/0250405 | A1 | 10/2011 | Sawatsky |
| 2014/0272438 | A1 | 9/2014 | Posey |
| 2015/0291806 | A1 | 10/2015 | Turner |
| 2016/0046835 | A1 | 2/2016 | Ye et al. |
| 2017/0050766 | A1 | 2/2017 | Turner |
| 2018/0155082 | A1 | 6/2018 | Turner |
| 2019/0031400 | A1 | 1/2019 | Turner |
| 2019/0161241 | A1 | 5/2019 | Turner |

FOREIGN PATENT DOCUMENTS

| | | |
|---|---|---|
| CN | 201542291 | 8/2010 |
| CN | 201612433 | 10/2010 |
| CN | 202009965 | 10/2011 |
| CN | 203168713 | 9/2013 |
| DE | 40 11 215 | 10/1990 |
| EP | 0 227 092 | 7/1987 |
| EP | 0 350 534 | 1/1990 |
| EP | 0 420 986 | 4/1991 |
| EP | 0 474 355 | 3/1992 |
| EP | 0 514 631 | 11/1992 |
| EP | 0 543 441 | 5/1993 |
| EP | 0 587 148 | 3/1994 |
| EP | 0 672 542 | 9/1995 |
| EP | 0 721 848 | 7/1996 |
| EP | 1 024 180 | 6/2000 |
| EP | 1344760 | 9/2003 |
| GB | 2484744 A | 4/2012 |
| GB | 2484774 A | 4/2012 |
| JP | 5-278745 | 10/1993 |
| JP | 8-333139 | 12/1996 |
| JP | 2004123462 | 4/2004 |
| KR | 20010078990 | 8/2001 |
| KR | 20080079832 | 9/2008 |
| WO | 2000/53413 | 3/2000 |
| WO | 2007/021780 | 2/2007 |
| WO | 2007/027710 | 3/2007 |
| WO | 2009/053721 | 4/2009 |
| WO | 2009/138786 | 11/2009 |
| WO | 2013/160630 | 10/2013 |
| WO | 2015/166244 | 11/2015 |
| WO | 2016/102963 | 6/2016 |

OTHER PUBLICATIONS

4, Jan. 24, 2013, PCT/GB2012/050900, PCT
5, Apr. 28, 2014, PCT/GB2012/050900, PCT.
6, Aug. 26, 2014, PCT/GB2012/050900, PCT.
4, Jan. 10, 2012, GB1115663.5, GB.
4, May 23, 2014, GB1115663.5, GB.
4, Dec. 10, 2014, GB1115663.5, GB.
10, Mar. 3, 2016, PCT/GB2015/054134, PCT.
5, Dec. 23, 2016, PCT/GB2015/054134, PCT.
5, Mar. 1, 2017, 15 723 281.0, EP.
3, Mar. 17, 2017, 15 723 281.0, EP.
9, Apr. 4, 2017, U.S. Appl. No. 15/307,794, US.
8, Apr. 12, 2017, PCT/GB2015/054134, PCT.
8, May 8, 2017, U.S. Appl. No. 14/396,923, US.
12, Jul. 27, 2017, U.S. Appl. No. 14/396,923, US.
12, Dec. 20, 2017, U.S. Appl. No. 14/396,923, US.
11, Mar. 20, 2018, U.S. Appl. No. 15/832,599, US.
4, May 1, 2018, U.S. Appl. No. 14/396,923, US.
17, May 22, 2018, 201580036558.8, CN.
14, Sep. 18, 2018, U.S. Appl. No. 15/832,599, US.
15, Dec. 5, 2018, 201580023617.8, CN.
7, Dec. 14, 2018, U.S. Appl. No. 15/539,062, US.
9, Feb. 7, 2019, U.S. Appl. No. 15/832,599, US.
18, Mar. 8, 2019, U.S. Appl. No. 15/539,062, US.
18, Feb. 27, 2019, 201580036558.8, CN.
8, Sep. 29, 2015, PCT/GB2015/051252, PCT.
4, May 9, 2017, GB1700408.06, GB.
9, Mar. 25, 2019, PCT/GB2018/050056, PCT.
17, Aug. 2, 2019, U.S. Appl. No. 15/539,062, US.
12, Aug. 7, 2019, U.S. Appl. No. 16/203,452, US.
4, Aug. 26, 2019, U.S. Appl. No. 15/539,062, US.
U.S. Appl. No. 15/539,062, filed Jun. 22, 2017, PCT/GB2015/054134, Dec. 22, 2015.
U.S. Appl. No. 16/203,452, filed Nov. 28, 2018.
8, Nov. 15, 2019, U.S. Appl. No. 16/203,452, US.
14, Jan. 31, 2020, U.S. Appl. No. 15/539,062, US.
Database WPI Accession No. 1997-095320, Jan. 3, 2013.
International Search Report dated Jan. 24, 2013 for PCT Application No. PCT/GB2012/050900, 3 pages.
GB Intellectual Property Office Search Report dated Jan. 10, 2012 for GB Application No. GB1115663.5, 2 pages.
GB intellectual Property Office Search Report dated Oct. 20, 2014 for GB Application No. GB1407546.9, 5 pages.
International Search Report and Written Opinion dated Mar. 3, 2016 for PCT Application No. PCT/GB2015/054134, 10 pages.
European Community Design Registration No. 02305375-0001, (Sep. 9, 2013).
European Community Design Registration No. 02305375-0002, (Sep. 9, 2013).
European Community Design Registration No. 02305375-0003, (Sep. 9, 2013).
GB Intellectual Property Office Search Report dated May 9, 2017 for GB Application No. GB1700408.6, 4 pages.

(56) References Cited

OTHER PUBLICATIONS

International Search Report and Written Opinion dated Feb. 27, 2018 for PCT Application No. PCT/GB2018/050056, 15 pages.
R39, 10 pages, dated Nov. 19, 2020, U.S. Appl. No. 15/539,062.
R41, 12 pages, dated Nov. 2, 2020, Application No. 2015800365588.
R45, 4 pages, dated Oct. 13, 2020, Application No. 15820582.3.
Wang, S. (edited by) "Coating technology", Beijing Chemical Industry Press, vol. 3, pp. 330-343, (1996).
Notification of Reexamination of CN application No. 20158003655388 dated Nov. 2, 2020, with translation, 12 pages.
R47, 6 pages, dated Jan. 7, 2021, U.S. Appl. No. 15/539,062.
R48, 5 pages, dated Jan. 12, 2021, U.S. Appl. No. 15/539,062.

* cited by examiner (A)

(B)

(C)

(A)

(B)

(A)

(B)

(C)

(A)

(B)

(C)

(D)

VACUUM DECORATION OF A DRINKING OR EATING VESSEL

BACKGROUND

The present invention relates to methods of decoration, in particular decoration of drinking or eating vessels under at least partial vacuum conditions. Also encompassed are drinking or eating vessels obtainable by such methods.

Drinking and eating vessels made from hard surface substrates such as ceramic or glass are often decorated, for example with a decorative pattern or image such as a graphic image or photographic image. Known decoration processes include silk screen printing, either directly to the substrate or via decals. However, these decoration processes require large runs to justify the set-up costs.

Another known decoration process is vacuum sublimation printing. Said process employs the use of a transfer sheet which is printed using inks capable of sublimation. Typically, the transfer sheet is applied to the object to be printed under vacuum and heat (at least 200° C.) allowing sublimation of the ink (and thus decoration) to said object.

Conventional decoration methods however do not allow for full coverage, high quality printing of drinking or eating vessels that have appendages, such as handles and the like. Moreover, when the present inventions attempted to use vacuum dye sublimation to decorate drinking or eating vessels they encountered (and had to overcome) numerous problems associated with said method, including breakage (e.g. shattering) of the drinking or eating vessel under vacuum and/or over-stressing of the transfer sheet (leading to delamination and/or bursting and/or vacuum loss) and/or poor quality decoration of the drinking or eating vessel and/or poor forming of the transfer sheet around the drinking or eating vessel and/or blistering of the transfer sheet and/or poor alignment and/or edge-to-edge consistency of the transferred decoration.

SUMMARY

There is therefore a need for an improved method for decorating a drinking or eating vessel, and a need for a drinking or eating vessel with full coverage and high quality decoration.

The present invention provides a solution to one or more of the above-described problems.

In one aspect the present invention provides a method for decorating a drinking or eating vessel, the method comprising:

a. providing:
   i. a drinking or eating vessel, wherein the vessel comprises an inner surface that defines a volume for receiving a liquid or a solid food and an outer surface comprising a polymeric coating; and
   ii. a transfer sheet, wherein the transfer sheet comprises a printed decoration; and
   iii. a supporting means comprising a recess for receiving the vessel; and
b. arranging the vessel within the recess of the supporting means thereby defining a lower portion of the outer surface of the vessel occluded from contact with the transfer sheet and an upper portion of the outer surface of the vessel for contacting the transfer sheet; and
c. contacting the upper portion of the outer surface of the vessel and the supporting means with the transfer sheet under at least a partial vacuum, wherein the printed decoration is transferred from the transfer sheet to the upper portion of the outer surface of the vessel (e.g. the polymeric coating of said vessel), and wherein the supporting means reduces stretching of the transfer sheet from the upper portion of the outer surface of the vessel to the lower portion of the outer surface of the vessel.

There is also provided in a related aspect use of a supporting means comprising a recess for receiving a drinking or eating vessel for:

i. reducing delamination of a transfer sheet; and/or
ii. reducing bursting of a transfer sheet; and/or
iii. reducing loss of an at least partial vacuum; and/or
iv. improving transfer of a printed decoration from a transfer sheet to the vessel during a contacting step;

wherein the vessel comprising an inner surface that defines a volume for receiving a liquid or a solid food and an outer surface comprising a polymeric coating is arranged within the recess of the supporting means thereby defining a lower portion of the outer surface of the vessel occluded from contact with a transfer sheet comprising a printed decoration, and an upper portion of the outer surface of the vessel for contacting the transfer sheet, and wherein the upper portion of the outer surface of the vessel and the supporting means are contacted with the transfer sheet under at least a partial vacuum, wherein the printed decoration is transferred from the transfer sheet to the upper portion of the outer surface of the vessel (e.g. the polymeric coating of said vessel), and wherein the supporting means reduces stretching of the transfer sheet from the upper portion of the outer surface of the vessel to the lower portion of the outer surface of the vessel.

The technical effects described as points i. to iv. above are a reduction/improvement when compared to an equivalent process carried out under the same conditions but omitting the use of a supporting means of the invention. In one embodiment use according to the present invention provides for reducing delamination of the transfer sheet. In another embodiment use according to the present invention provides for reducing bursting of the transfer sheet. In one embodiment use according to the present invention provides for reducing loss of the at least partial vacuum (during a contacting step). In another embodiment use according to the present invention provides for improving transfer of the printed decoration from the transfer sheet to the drinking or eating vessel.

The term "reducing" or "reduces" as used herein encompasses partial and complete reduction (i.e. prevention). In one embodiment the term "reducing" or "reduces" means "preventing" or "prevents".

The term "improving transfer" as used herein encompasses improving the amount of ink (decoration) transfer from a transfer sheet to a drinking or eating vessel and/or improving the quality of the transferred decoration and/or the decorated drinking or eating vessel obtainable by said method.

The term "obtainable" as used herein also encompasses the term "obtained". In one embodiment "obtainable" means "obtained".

BRIEF DESCRIPTION OF THE DRAWINGS

Embodiments of the invention will now be described, by way of example only, with reference to the following Figures and Examples.

FIG. 7 illustrates an apparatus for decorating a drinking or eating vessel.

DETAILED DESCRIPTION

Figure 1:
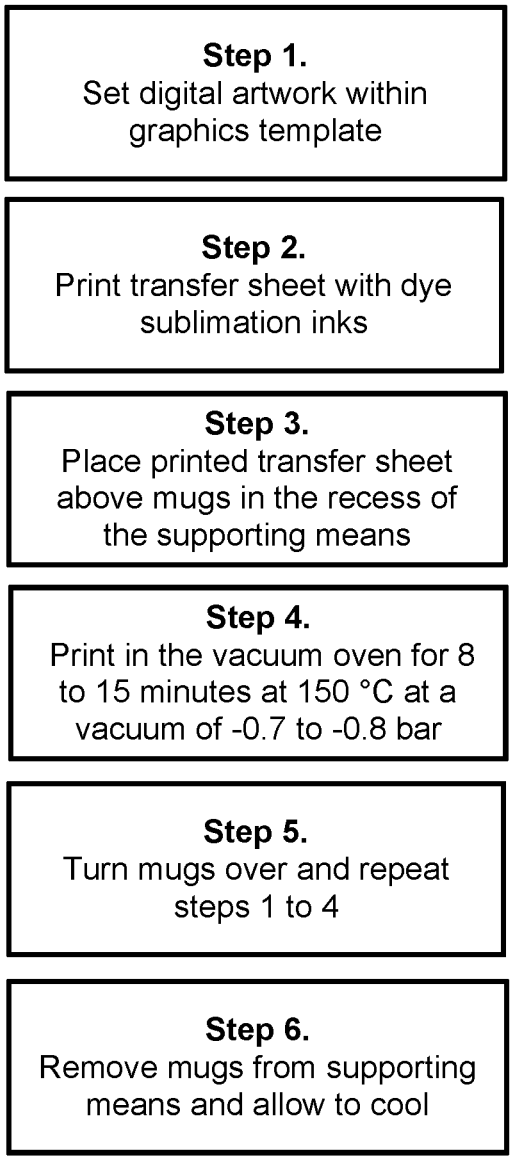
FIG. 1 shows a process flowchart for decorating a drinking vessel (e.g. a mug).

The contacting step is carried out under conditions such that the printed decoration is transferred from the transfer sheet to the outer surface of the drinking or eating vessel (e.g. the polymeric coating of said vessel) under at least a partial vacuum. The term "at least a partial vacuum" as used herein means a vacuum of at least −0.1 bar or −0.2 bar. In one embodiment "at least a partial vacuum" as used herein means a vacuum of at least −0.4 bar or −0.6 bar. Suitably "at least a partial vacuum" may mean a vacuum of at least −0.8 bar. In one embodiment the at least partial vacuum is between about −0.1 bar to about −0.9 bar, for example about −0.2 bar to about −0.9 bar. In another embodiment the at least partial vacuum is between about −0.4 bar to about −0.85 bar, suitably about −0.6 bar to about −0.8 bar. Other transfer conditions include a suitable temperature and transfer time. The person skilled in the art can optimise said conditions based on the decoration to be transferred to the drinking or eating vessel (e.g. darker designs may require additional transfer time).

In one embodiment the transfer temperature is between about 120° C. to about 210° C.

In one embodiment the transfer temperature is between about 120° C. to about 190° C., suitably between about 130° C. to about 170° C. This temperature range may find particular utility when used with transfer sheets manufactured from certain materials (e.g. PET), and may be used to prevent delamination and/or bursting and/or loss of an at least partial vacuum and/or may improve transfer of a printed decoration to a drinking or eating vessel, when compared to the use of temperatures in excess of this range. In one embodiment the transfer temperature is between about 140° C. to about 160° C. Suitably the transfer temperature may be between about 145° C. to about 155° C., for example at about 150° C. Conventional vacuum sublimation decorating methods employ temperatures of at least 200° C. in order to obtain acceptable transfer of printed decoration. It is surprising that contacting in this temperature range allows for acceptable transfer of printed decoration from a transfer sheet to a drinking or eating vessel.

In one embodiment the transfer time is between about 1.5 minutes to about 20 minutes or between about 5 to about 18 minutes. Suitably transfer time may be between about 7 to about 16 minutes. In one embodiment transfer time is between about 7 to about 9 minutes, e.g. for about 8 minutes. In one embodiment transfer time is between about 9 to about 11 minutes, e.g. for about 10 minutes. In one embodiment transfer time is between about 11 to about 13 minutes, e.g. for about 12 minutes. In one embodiment transfer time is between about 14 to about 16 minutes, e.g. for about 15 minutes.

Advantageously increasing transfer temperature to about 10 to about 16 minutes (for example about 12 to about 14 minutes) may improve the edge-to-edge consistency of decoration applied, especially where the method comprises a second contacting step.

In one embodiment the transfer temperature is between about 120° C. to about 170° C. and the transfer time is between about 5 to about 20 minutes. Suitably the transfer temperature may be between about 140° C. to about 160° C. (e.g. about 150° C.) and the transfer time may be between about 7 to about 9 minutes (e.g. about 8 minutes).

A supporting means comprises a recess for receiving a drinking or eating vessel. A recess may comprise an aperture and an inner surface defining an internal volume. When carrying out a method of the invention, the supporting means is positioned below the drinking or eating vessel and transfer sheet, and said vessel is arranged within the recess of the supporting means. The recess (optionally comprising a cushioning means) is dimensioned to receive a drinking or eating vessel (e.g. and to abut in a sealing manner) thereby reducing or preventing a transfer sheet from entering said recess. Suitably a cushioning means (e.g. forming a gasket at the interface between an outer surface (i.e. an upper surface of a supporting means) and inner surface of the recess (i.e. which inner surface defines the inner volume of said recess) may aid in reducing or preventing a transfer sheet from entering said recess. A lower portion of the outer surface of the vessel is located within the recess (i.e. in the inner volume of the recess) and is thereby occluded from contact with a transfer sheet. In contrast the upper portion of the outer surface of the vessel is capable of being contacted with a transfer sheet. Advantageously, this arrangement prevents stretching of the transfer sheet around the vessel (i.e. from the upper to the lower portion) when the at least partial vacuum is applied.

The term "reduces stretching of the transfer sheet" as used in this context refers to undesirable stretching of the transfer sheet under the contacting conditions (e.g. at least partial vacuum) that may lead to over-stressing of the transfer sheet (associated with delamination and/or bursting and/or vacuum loss). Stretching of the transfer sheet is reduced by a supporting means or component thereof.

The supporting means comprises an upper surface, and in one embodiment the surface area of said upper surface and the surface area of a transfer sheet comprising a printed decoration are substantially the same. In one embodiment the term "the surface area of said upper surface and the surface area of a transfer sheet comprising a printed decoration are substantially the same" means that the surface are of the transfer sheet is at least 80% or 90% of the surface area of the upper surface of the supporting means. Suitably the term "the surface area of said upper surface and the surface area of a transfer sheet comprising a printed decoration are substantially the same" may mean that the surface are of the transfer sheet is at least 95% or 100% of the surface area of the upper surface of the supporting means.

Suitably, a supporting means and a transfer sheet form a sandwich in-between which is positioned a drinking or eating vessel.

In one embodiment the drinking or eating vessel is arranged on its side (i.e. the side of the vessel when in normal use) within a recess of the supporting means.

The supporting means typically comprises one or more apertures to facilitate initiation and maintenance of the vacuum (e.g. which initiates and maintains directional movement of ink from the transfer sheet towards the upper portion of the drinking or eating vessel). The apertures may be positioned around key process areas (e.g. in proximity to a drinking or eating vessel appendage) to improve forming of the transfer sheet around a drinking or eating vessel. Said apertures may comprise one or more temperature-tolerant seal(s). The temperature-tolerant seal(s) may be formed from any vacuum and/or temperature-tolerant material, for example silicone, silicone rubber or rubber.

Alternatively or additionally, a temperature-tolerant seal may be applied to the edges of a supporting means, where said means abuts an inner wall of a vacuum sublimation apparatus. Advantageously use of a temperature-tolerant seal in this manner may prevent a transfer sheet being stretched around the edges/sides of a supporting means and thus reduce over-stressing of the transfer sheet.

The supporting means may be formed from any vacuum and/or temperature-tolerant material. For example a supporting means may be a metal, or plastic supporting means. Suitably metals may include steel, whilst suitable plastics may include polyoxybenzylmethylenglycolanhydride.

In one embodiment a supporting means comprises a cushioning means. Said cushioning means is suitably located in the recess (e.g. within an internal volume) or at an aperture of a supporting means (e.g. at the interface between an outer and inner surface of the supporting means, for example as a temperature-tolerant seal). The cushioning means may be formed from any vacuum and/or temperature-tolerant material, for example the cushioning means may be a silicone, silicone rubber or rubber cushioning means or may be formed from a foam. Advantageously, use of cushioning means may reduce physical pressure on a drinking or eating vessel during a method of the invention, thus reducing breakage (e.g. shattering) of said vessel.

In one embodiment during contacting a stopping means is arranged to occlude (e.g. prevent access to) a volume defined by an inner surface of a drinking or eating vessel. In other words, a stopping means may occupy at least a portion of the volume within the inner surface of the drinking or eating vessel to reduce or prevent contact between the inner surface of the drinking or eating vessel and the transfer sheet.

Suitable stopping means include for example a stopper, wherein the stopper forms a seal closing an aperture in a drinking or eating vessel or a cap. Preferably, a stopping means is positioned in the volume defined by the inner surface of a drinking or eating vessel. For example, where a drinking or eating vessel is cylindrical the stopping means may contact the entire circumference of the inner surface of said cylindrical drinking or eating vessel, alternatively or additionally a stopping means may fill (or substantially fill) the volume defined by the inner surface of a drinking or eating vessel. Advantageously, use of a stopping means prevents a transfer sheet from being forced under at least a partial vacuum into the volume defined by the inner surface of a drinking or eating vessel, and may thus reduce or prevent over-stressing of the transfer sheet (associated with delamination and/or bursting and/or vacuum loss).

A stopping means may be manufactured from any suitable material, for example a stopping means may be a metal, silicone, silicone rubber or rubber stopping means. In some embodiments a stopping means is manufactured from a plurality of material, and for example may comprise a metal portion, and a silicone, silicone rubber, or rubber portion.

A stopping means may take any suitable form for fulfilling its function. Suitably, a stopping means may be disc-shaped. In one embodiment a stopping means comprises a first and second disc. The discs may be manufactured from the same or different materials (preferably different materials). In one embodiment (in use) one of the discs is positioned within a volume of a drinking or eating vessel, whilst the second disc is positioned externally to said vessel.

In one embodiment a stopping means comprises one or more aperture(s). Suitably, a stopping means may comprise a plurality of apertures, such as two or more or three or more apertures. In a preferred embodiment a stopping means comprises four or more apertures (more preferably five apertures). Advantageously said aperture(s) serve to balance the air pressure on the inside and outside of a drinking or eating vessel, and may reduce breakage (e.g. shattering) of the drinking or eating vessel.

Any combination of the foregoing embodiments is intended and encompassed by the present invention.

The term "transfer sheet" as used herein refers to a medium capable of receiving a dye sublimation ink, and subsequently transferring said ink to a drinking or eating vessel under at least a partial vacuum and under appropriate conditions (e.g. at an appropriate transfer temperature and time as described herein). The transfer sheet is suitably manufactured form a formable plastic. In one embodiment a transfer sheet is a polyethylene terephalate (PET) transfer sheet. Where a PET transfer sheet is used, said PET transfer sheet may be pre-treated (e.g. coated with a printable coating) to facilitate printing of decoration onto said transfer sheet (e.g. by way of an Inkjet printer). The skilled person is aware of printable coatings that can be applied to PET transfer sheets, and PET transfer sheets comprising said coatings are commercially available as described herein.

A PET transfer sheet finds particular utility in the present invention as the inventors have found that it is capable of forming around the complex shape of a drinking or eating vessel, for example a drinking or eating vessel comprising an appendage such as a handle. Thus in one aspect there is provided use of a formable plastic transfer sheet (e.g. a PET transfer sheet) comprising a printed decoration for decorating a drinking or eating vessel. Examples of suitable PET transfer sheets include: Caseblanks white film (170 micron) commercially available from Shenzhen Caseblanks Technology Co., Ltd, A-3rd Floor, Junfeng Innovation Technology Park, Chongqing Rd, Fuyong Town, Baoan District, 518103, Shenzhen, Guangdong, China; SMI technology 3D silver-backed film (270 micron) commercially available from SMI Coated Products Private Limited, 11-B-2, Gundecha Onclave, Kherani Road, Sakinaka, Andheri East, Mumbai 400 072, India; and Technotape silver film 'Xtreme 3D film' (270 micron) commercially available from Technotape, Tolweg 7, Baarn, 3741LM, Holland.

In one embodiment a transfer sheet (suitably a PET transfer sheet) has a thickness of between about 150 to about 300 microns. In one embodiment a transfer sheet (suitably a PET transfer sheet) has a thickness of between about 160 to about 180 microns (e.g. about 170 microns). In one embodiment a transfer sheet (suitably a PET transfer sheet) has a thickness of between about 260 to about 280 microns (e.g. about 270 microns).

Decoration is printed onto a transfer sheet using any suitable technique. In one embodiment decoration is printed onto a transfer sheet using an Inkjet printer (such as a Ricoh SG800 (Virtuoso® SG800) or Mimaki® JV33). Suitably, said transfer sheet is allowed to dry (e.g. for at least 10 minutes, for example between 10-30 minutes at room temperature) following printing prior to being used in a method of the present invention. Advantageously this can reduce or prevent blistering of the transfer sheet (e.g. PET transfer sheet) allowing for improved transfer of printed decoration.

Any sublimation ink suitable for use on ceramic or glass may be used with the present invention. An example of an ink suitable for use in a dye sublimation process is an organic (aqueous) ink.

Examples of such inks are available from Sawgrass Europe, Jubilee House, Hillsborough, Sheffield, S6 1LZ, United Kingdom. Examples may include Rotech Cyan, Magenta, Yellow, Black, Black Plus, Light Cyan, Light Magenta, and Light Black.

A further example of an ink suitable for use in dye sublimation is an ink-jet ink for transfer printing that is applied (e.g. sets or cures) at a temperature of up to 210° C., for example at a temperature of up to 190°, or in the temperature range 120 to 210° C. Examples of such inks are available from Sensient Imaging Technologies SA, Specialty Inks and Colors, ZI Riond-Bosson 8, 1110 Morges 2, Switzerland. An example of such an ink has the name S4 Subli Blue 770 (article No. 648770VV).

Contacting a drinking or eating vessel with a transfer sheet may be effected by any means that facilitates transfer of the printed decoration from said transfer sheet to a polymeric coating of the drinking or eating vessel. For example, the transfer sheet may be held in close proximity to the outer surface of a drinking or eating vessel.

In one embodiment, the height of a lower portion of a drinking or eating vessel occluded by a recess of a supporting means from contact with a transfer sheet is the same or less than the height of an upper portion of said vessel, wherein the upper portion is capable of being contacted by a transfer sheet. Suitably, the height of the lower portion is less that the height of an upper portion as defined by the depth of the recess of said supporting means. Advantageously, arranging a vessel in this manner results in improved/optimal transfer sheet tension and thus may improve forming of the transfer sheet around the drinking or eating vessel and/or facilitate transfer of the printed decoration to said drinking or eating vessel.

The present invention encompasses both complete and partial transfer of a printed decoration from a transfer sheet to a polymeric coating of a drinking or eating vessel. The term "partial transfer" as used herein means transfer of 30% or more or 40% or more of a printed decoration. In one embodiment the term "partial transfer" as used herein means transfer of 50% or more of a printed decoration, for example 60% or more. Suitably partial transfer may mean transfer of 70% or more or 80% or more of a printed decoration. In one embodiment partial transfer means transfer of 90% or more or 95% or more of a printed decoration, for example 99% or more.

In one embodiment during contacting an additional sheet is applied over the transfer sheet comprising the printed decoration to improve contact between the transfer sheet comprising the printed decoration and the drinking or eating vessel. The additional sheet may be formed of the same or different (preferably the same) material as the (first) transfer sheet comprising the printed decoration. Suitably a second sheet may not comprise a printed decoration. The term "applied over" may mean that the second sheet completely or partially (preferably completely) overlaps the transfer sheet comprising the printed decoration. In one embodiment the additional sheet may have a thickness between about 50 microns to about 150 microns, for example between about 80 microns to about 120 microns. Suitably, an additional sheet may have a thickness of about 100 microns.

In one embodiment a method of the invention is a two-step process. A two-step process may be employed where there is a requirement to apply printed decoration to all or substantially all of the outer surface of a drinking or eating vessel. For example, a two-step process may comprise printing approximately one half of the outer surface of said drinking or eating vessel in a first step and approximately the other half of the outer surface in a second step.

Thus, in one embodiment a method of the invention further comprises re-arranging the vessel within the recess of the supporting means thereby defining a different lower and upper portion of the vessel, and repeating step c. using a second transfer sheet comprising a printed decoration.

In one embodiment prior to a contacting step a barrier means is applied to a drinking or eating vessel defining a non-print area. A "barrier means" is any means that prevents transfer of a printed decoration from a transfer sheet to a polymeric coating of a drinking or eating vessel. In one embodiment a barrier means is a tape (e.g. heat resistant tape). Use of a barrier means may be particularly advantageous in a two-step method described above, as it may facilitate alignment of the transferred printed decoration and/or reduce or prevent double printing/transfer and/or lack of printing/transfer. Thus, in one embodiment a barrier means is applied prior to a first transfer step, and removed prior to carrying out a second transfer step. Additionally or alternatively a barrier means (e.g. second barrier means) may be applied prior to carrying out a second transfer step.

Computer graphics software may also be employed to aid in preparation of the printed decoration, and provide printed decoration configured such that it is aligned when transferred to a drinking or eating vessel using the two-step method described.

In one aspect there is provided a drinking or eating vessel obtainable by a method of the invention.

The term "drinking or eating vessel" includes vessels such as cups, mugs, bowls, and plates. The term "drinking or eating vessel" also includes storage vessels (for example, bottles and jars) of the type from which food products may be directly consumed. Preferably a "drinking or eating vessel" is a cup or a mug.

The drinking or eating vessel may be made of any suitable material known in the art and may be of any suitable shape and design known in the art. In one embodiment, the vessel is a ceramic vessel. By way of example, the vessel may be made from bone china, porcelain, earthenware or stoneware. In one embodiment, the vessel is a glass vessel. The drinking or eating vessel may also be made of metal, for example steel (e.g. stainless steel) or aluminium.

In one embodiment a drinking vessel is a travel mug. A travel mug may comprise a handle, a lid, and means for reducing cooling of the contents of said mug (e.g. insulating means). A travel mug may comprise ceramic, glass, metal or combinations thereof. For example, the travel cup or mug may comprise one or more of bone china, porcelain, earthenware, stoneware, steel (e.g. stainless steel), aluminium or combinations thereof.

In one embodiment a drinking or eating vessel does not comprise (or consist of) plastic.

The vessel has an inner surface and an outer surface. The inner surface is found on the inside (during normal use) of the vessel, namely the portion in which liquid or solid food is received or held, or on which said food is supported. The outer surface is found on the external side (during normal use) of the vessel before any coating process of the invention has been applied. The outer surface includes the external surface provided by the body of a vessel and includes the external surface of any appendage (e.g. a handle) thereto. Preferably the outer surface also includes the base (i.e. on which the drinking or eating vessel stands during normal use).

The vessels of the invention have a polymeric coating. A coating is a layer of material that is applied onto a surface of the vessel. The polymeric coating may be applied to an outer surface of the vessel, or to an inner surface of the vessel, or to both an outer and an inner surface of the vessel.

The polymeric coating may be applied in any suitable and appropriate manner, for example by spray coating or by dip coating. Suitable spray coating processes include High Volume Low Pressure (HVLP) spray application.

In a preferred embodiment a polymeric coating may be applied using one or more HVLP spray gun(s), wherein the spray gun(s) and/or drinking or eating vessel are movable relative to each other (e.g. on multiple axes) to enable consistent application (e.g. substantially complete application) of said polymeric coating to the outer surface of the drinking or eating vessel including the base. Such a coating method is described in Example 4 herein, and may suitably be effected via user-programmable robotics. Advantageously, drinking or eating vessels coated using this method perform particularly well when decorated using a method of the invention and exhibit improved transfer of printed decoration, e.g. at the base and handle (particularly at the upper handle, lower handle, and inside said handle). The improvement is observable compared to drinking or eating vessels coated using processes where application of the polymeric coating to the outer surface is less consistent, for example dipping (coating is prone to run and clump at particular regions), and/or HVLP spraying of a drinking or eating vessel movable on one axis (e.g. on a rotating pedestal—which prevents application of polymeric coating to the base).

Suitably, the drinking or eating vessel and/or spray gun(s) may be movable relative to one another on 2, 3, 4, 5 or 6 or more (preferably 6) axes. Suitably a plurality of spray guns (e.g. two spray guns) are employed.

Alternatively or additionally, where all or substantially all of the outer surface of a drinking or eating vessel is arranged to be sprayed, it may not be necessary for the drinking or eating vessel to be movable, and a plurality of spray guns may be employed to achieve substantially consistent application (e.g. substantially complete application) of a polymeric coating to the outer surface of the vessel.

The term "substantially complete application" as used in this context means that a polymeric coating is applied to at least 90% or 95% of the outer surface of a drinking or eating vessel. Suitably the term "substantially complete application" may mean that a polymeric coating is applied to at least 98% or 99% (preferably 100%) of the outer surface of a drinking or eating vessel.

The polymeric coating may be a white coating.

The polymeric coating may be a clear, colourless, transparent or translucent coating.

The polymeric coating of the vessel may be cured onto the outer surface (and/or inner surface) of the drinking vessel at a curing temperature of less than 600° C., for example less than 400° C. or less than 300° C. Suitable polymers are well known to a skilled person.

In one embodiment, the coating is a coating that is produced by curing at a temperature of 180-240° C.

"Cured" and "curing" refers to the chemical process of curing, via which process a composition (typically containing monomers or small polymers) hardens (for example, due to the formation of cross-linking) when exposed to heat, air, ultraviolet radiation, infrared radiation or chemical additives. Thus, the coating may be produced by curing a coating mixture to form a hardened coating.

Thus, in one embodiment, the polymeric coating is produced by applying a coating mixture to a vessel followed by curing of the coating mixture at a temperature conducive to coating formation. A "coating mixture" comprises (or consists of) the ingredients that cure to form a coating on a vessel.

In one embodiment, the polymeric coating of a drinking or eating vessel comprises a matting agent. Examples of such drinking or eating vessels are taught in WO 2015/166244 A1 and WO 2016/102963 A1 the contents of which are incorporated herein by reference.

A drinking or eating vessel comprising a matting agent typically comprises a polymeric coating comprising (or consisting of): (i) a polymer formed at a curing temperature of less than 250° C., and (ii) a matting agent.

In one embodiment the polymer is a non-glass polymer.

The coating may comprise (or consist of): (i) one or more of: a polyurethane (lacquer or paint), an epoxy (resin), a polyester, an acrylic, or mixtures thereof, and optionally (ii) a matting agent. An epoxy may be a thermosetting copolymer that is formed by the reaction between an epoxide and a polyamine. The coatings may be provided as, for example, a water-based coating mixture or a solvent-based coating mixture.

In one embodiment, the coating comprises a cured polyurethane and/or a cured epoxy (resin). For example, the coating may comprise (or consist of): (i) polyurethane, and optionally (ii) a matting agent. In one embodiment, the coating comprises (or consists of): (i) an epoxy, and optionally (ii) a matting agent.

For example, the coating may comprise (or consist of): (i) a polymeric blocked aliphatic diisocyanate epoxy, or an aliphatic (acrylic) polyurethane, and optionally (ii) a matting agent.

A typical epoxy (resin) composition may comprise (or consist of):

- polyisocyanate (e.g. an aliphatic diisocyanate based polyisocyanate), for example 5-30 wt. %;
- propylene glycol or ether acetate (e.g. a propylene glycol monomethyl ether acetate), for example 10-40 wt. %);
- xylene (CAS No. 1330-20-7), for example 1-15 wt. %;
- an organic solvent (e.g. solvent naptha), for example 1-10 wt. %; and
- an epoxy resin (for example, 5-20 wt. %);

where wt. % values are indicated, said composition components add up to 100%.

An example of an epoxy (resin) composition comprises (or consists of):

- methyl ethyl ketoxime-blocked aliphatic diisocyanate based polyisocyanate 30 wt %;
- propylene glycol monomethyl ether acetate (CAS No. 108-65-6) 40 wt %;
- xylene (CAS No. 1330-20-7) wt %;
- aromatic 100 (solvent naptha) (CAS No. 64742-95-6) 0 wt %; and
- epoxy resin 20 wt %;

where wt. % values are indicated, said composition components add up to 100%.

By way of specific example, reference is made to DuraGlaze™, which is a polymeric blocked aliphatic diisocyanate epoxy resin.

Thus, the coating may comprise (of consist of): (i) DuraGlaze™, and optionally (ii) a matting agent.

A yet further example of an epoxy coating comprises (or consists of):

- an ethanol component (e.g. 2-(2-butoxyethoxy)ethanol), e.g. 5-15 wt. %;
- an organic solvent component (e.g. xylene), e.g. 25-50 wt. %;
- a butanol component (e.g. n-butanol), e.g. 5-15 wt. %; and
- epoxy resin (e.g. number average molecular weight 700), e.g. >50 wt. %;

where wt. % values are indicated, said composition components add up to 100%.

An example of a suitable epoxy coating is Ceraglaze S1475, which may be obtained from Neogene LLP, Watford, Hertfordshire, United Kingdom.

By way of example, epoxy coatings such as Ceraglaze S1475 typically cure in 8-14 minutes at a temperature of 180-240° C.

The coating may comprise an organic coating, such as a Transparent Stoving Finish (TSF). By way of example, a TSF may be a blend of polyurethane and epoxy resin.

A typical TSF may comprise (or consist of):

- 2-methoxy-1-methylethyl acetate (CAS No. 108-65-6) 5-15%;
- n-butyl acetate (CAS No. 123-86-4) 5-15%;
- xylene (CAS No. 1330-20-7) 25-50%;
- ethylbenzene (CAS No. 100-41-4) 5-15%; and
- epoxy resin (number average molecular weight 700) (CAS No. 25068-38-6) 1-5%;

where wt. % values are indicated, said composition components add up to 100%.

Commercially available examples of TSFs are available from Neogene LLP, Watford, Hertfordshire, United Kingdom, such as TSF product code S1805.

The coating may comprise (or consist of): (i) a polyester, and optionally (ii) a matting agent.

Other coating materials may be employed and are well known to a skilled person.

In one embodiment the polymeric coating is not a glass layer. For example, the polymeric coating of the present invention may not be one that is obtained by glazing, which refers to heating a coating mixture at a temperature greater than 650° C. (for example, 1210° C.).

The polymeric coating may be a coating which is resistant to damage when the coated vessel is washed (for example, by hand, or in a dishwasher). Examples of such coatings include polyurethane lacquers/paints, epoxy resins and polymeric blocked aliphatic diisocyanate epoxy resins (e.g. DuraGlaze™ as described above).

The polymeric coating of a drinking or eating vessel of the invention is formed by curing a coating mixture on the outer surface of the drinking or eating vessel, said coating mixture optionally comprising a matting agent. When a matting agent is provided in the coating mixture produces a coated vessel that has a matt appearance and/or surface texture.

Application of a decorative layer to such a coated vessel, wherein the decorative layer forms a diffuse layer within the polymeric coating, advantageously produces a decorated drinking or eating vessel where the decoration has a matt appearance and finish. This produces a sharp and clear decoration that is easy for a user to view, and which has few or no distortions. The matt finish enhances the quality of an image reproduced as part of the decoration. Furthermore, the matt finish reduces or eliminates reflections that may render the decoration difficult for a user to see.

In one embodiment, a drinking or eating vessel of the invention is dishwasher resistant. By way of example, the decorative layer may be resistant to at least 250, 300, 400, 500, 600, 700, 750, 800 or 1000 dishwasher cycles. Tests for assessing the dishwasher resistance of drinking or eating vessels are known to a skilled person; for example, British Standard BS EN 12875-4:2006, "Mechanical dishwashing resistance of utensils".

Where the drinking or eating vessel comprises a matting agent, the degree of matt finish displayed by said vessels may be altered by varying the amount of matting agent present in the polymeric coating. A low amount of matting agent will produce a finish that retains some properties of reflectivity, whereas a high amount of matting agent will produce a finish that is very matt with no reflectivity.

In one embodiment at least 1, 5, 10, 20, 40, 60, 80, 100, 120, 140, 160, 180, 200, 220, 240, 260, or 280 grams of matting agent are used per litre of coating mixture. In one embodiment less than 1000, 500, 250, 200, 150 or 100 grams of matting agent are used per litre of coating mixture.

In some embodiments 1 to 500 g of matting agent (e.g. 1 to 250 g or 1 to 150 g of matting agent) is used per litre of coating mixture. In some embodiments 10 to 500 g of matting agent (e.g. 10 to 250 g or 10 to 150 g of matting agent) is used per litre of coating mixture An optimum matt finish may be achieved when the matting agent is present in the polymeric coating at a concentration of between approximately 20 and 100 parts per 1000 (equivalent to approximately 20 to 100 grams of matting agent per litre of coating mixture), for example between approximately 40 and 80 parts per 1000. In one embodiment, the matting agent is present in the polymeric coating at a concentration of approximately 60 parts per 1000 (approximately 60 grams matting agent per litre of coating mixture).

In one embodiment, the matting agent comprises (or consists of) silica particles. For example, the matting agent may comprise (or consist of) precipitated silica, or the matting agent may comprise (or consist of) fumed silica.

The precipitated silica may have undergone an after-treatment, for example with wax.

In one embodiment, the matting agent comprises (or consists of) precipitated silica having an average particle size of approximately 2-20 μm, for example approximately 2-16 μm, 2-12 μm, 2-10 μm, 4-12 μm, 4-10 μm, 4-8 μm, or 5-6 μm. In one embodiment, the matting agent comprises (or consists of) precipitated silica having an average particle size of approximately 2, 4, 6, 8, or 10 μm.

In one embodiment, the matting agent comprises (or consists of) fumed silica having an average particle size of 4-8 (e.g. 5-6) μm.

In one embodiment, the term "average particle size" refers to average agglomerate particle size $d_{50}$ as measured by laser diffraction.

An example of a suitable silica matting agent is ACEMATT® OK 412 (CAS-No. 112926-00-8 (ex 7631-86-9), 9002-88-4), a fine-grained precipitated silica after-treated with wax, having an average particle size of 6.3 μm, which is produced by Evonik Industries AG.

A further example of a suitable silica matting agent is ACEMATT® OK 607, a fine-grained precipitated silica after-treated with wax, having an average particle size of 4.4 μm, which is produced by Evonik Industries AG.

A further example of a suitable silica matting agent is SYLOID® ED 30, having an average particle size of 5.0-6.0 μm, a pH of 6.0-8.5, a pore volume of 1.8 ml/g and a surface treatment of 10% wax, which is produced by Neogene LLP, Watford, Hertfordshire, United Kingdom.

A drinking or eating method described herein may comprise an anti-microbial coating, for example as described in WO2013/160630, the contents of which is incorporated herein by reference. An anti-microbial coating comprises an anti-microbial particle that comprises (or consists of) at least one anti-microbial agent. In one embodiment, the anti-microbial agent comprises silver. In one embodiment, the anti-microbial agent comprises (or consists of) silver chloride. Silver chloride is known to have anti-microbial effects, which have been attributed to the anti-microbial properties of silver ions. Accordingly, other silver halides may be similarly employed. Other anti-microbial agents are suitable for use in the present invention, for example anti-microbial agents containing metals other than silver. Non-limiting examples include anti-microbial agents comprising one or more of the following metals: mercury, copper, iron, lead, zinc, bismuth, gold, and aluminium. Chlorides and other halides of these metals may be similarly employed.

The anti-microbial agent may be incorporated as part of a slow release anti-microbial particle. Thus, in one embodiment, the anti-microbial agent is provided in a form in which the active constituent is released at a controlled rate, thus increasing the lifetime of the anti-microbial agent and making it more effective. By way of example, anti-microbial agent may be coated onto titanium oxide particles, which act as a carrier and provides slow release properties. Other suitable metal oxide carrier particles may be similarly employed, and include one or more of sodium antimony oxide, zinc iron manganese titanium oxide, iron titanium oxide, manganese antimony oxide, and manganese titanium oxide.

In one embodiment, the anti-microbial agent comprises (or consists of) titanium oxide particles coated with silver chloride. Said coated particles advantageously have slow release properties.

The coating mixture (and thus the resultant coating) may comprise the anti-microbial agent at a concentration of 0.1 to 5 wt. %, for example 0.1 to 1 wt. %, 0.1 to 0.5 wt. %, or 0.3 to 0.5 wt. %. By way of example, the coating mixture (and thus the resultant coating) may comprise the anti-microbial agent at a concentration of 0.1, 0.2, 0.3, 0.4, 0.5, 0.6, 0.7, 0.8, 0.9, 1.0, 2.0, 3.0, 4.0 or 5.0%.

In one embodiment, the anti-microbial coating mixture is applied to a vessel already having a printed decoration (e.g. forming a decorative layer) present on the outer surface, such that the coating forms the outermost surface of the vessel. Thus, the coating overlays said printed decoration (e.g. forming a decorative layer). The coating may be transparent (or equivalent), in order for the printed decoration (e.g. forming a decorative layer) to remain visible. Advantageously, the resulting vessel demonstrates an uncompromised anti-microbial outermost layer.

In some embodiments a drinking or eating vessel described herein comprises a coating described in US 2016/0046835 A1 (which is incorporated herein by reference). For example, a coating may comprise 70 to 99 parts of polyurethane, 0.4 to 10 parts of inorganic nano silicon oxides, 0.3 to 10 parts of inorganic nano aluminium oxides, and/or 0.3 to 10 parts of inorganic nano zirconium oxides.

The drinking or eating vessels manufactured by a method of the invention comprise a printed decoration (e.g. forming a decorative layer). Said printed decoration is transferred from a transfer sheet to the polymeric coating of the drinking or eating vessel. A printed decoration (e.g. forming a decorative layer) covers all or part of a surface (typically at least part of the outer surface) of the vessel, and may provide an aesthetic effect for the user. The printed decoration comprises one or more sublimation inks.

The printed decoration (e.g. forming a decorative layer) may be a pattern or an image such as a graphic image or a photographic image. The printed decoration may be coloured. Thus, by way of example, the printed decoration may comprise patterns, texts, logos, advertisements, or other designs (e.g. corporate branding or trademarks), or combinations thereof. The printed decoration may comprise an image or images, such as pictures or photographic images.

In one embodiment the printed decoration is a complex (e.g. continuous) pattern or design.

In embodiments where the drinking or eating vessel comprises an appendage (e.g. a handle), said drinking or eating vessel is characterised in that it comprises printed decoration (e.g. a complex (continuous) pattern or design) at a surface of the appendage facing the outer surface of the drinking or eating vessel. Conventionally, it has been difficult to apply a high quality (e.g. high resolution) printed decoration (e.g. a complex (continuous) pattern or design) to the surface of an appendage facing the outer surface of a drinking or eating vessel (when the appendage is affixed to the drinking or eating vessel). Advantageously, the method of the present invention solves this problem, allowing for the manufacture of drinking or eating vessels printed at this portion of an appendage. Suitably, a complex (e.g. continuous) pattern or design may be in-register across this portion of the appendage or the base of the drinking or eating vessel.

The printed decoration may cover part of an outer surface of the drinking or eating vessel. Alternatively, the printed decoration may cover all, or substantially all, of the outer surface of a drinking or eating vessel. The term "substantially all" means at least 80% or at least 90% of the total outer surface area of a drinking or eating vessel, for example at least 95% or 98% of the total outer surface area of a drinking or eating vessel. Suitably the term "substantially all" may mean at least 99% or 99.5% of the total outer surface area of a drinking or eating vessel. The term "outer surface" encompasses an appendage (e.g. a handle). In one embodiment the term "outer surface" also encompasses the base of a drinking or eating vessel.

In one embodiment the printed decoration is applied to the base of a drinking or eating vessel.

The printed decoration of the drinking or eating vessel may form a diffuse layer within the polymeric coating. Thus, upon application of the printed decoration to the coated vessel, the printed decoration may permeate the polymeric coating or be absorbed by the polymeric coating such that it forms a diffuse layer within the polymeric coating.

In one embodiment, the coating mixture is cured at a temperature of less than 250° C., or at a temperature in the range of 150-300° C. (e.g. in the range of 180-240° C.).

The coating mixture may be cured for a period of time of between 1 and 30 minutes, for example, 5-25 minutes, 5-20 minutes, 5-15 minutes, or 5-10 minutes.

In certain embodiments, the curing process requires heat. The heat required for the curing process may be provided by, for example, infrared radiation (such as in an infrared oven), or by convection (such as in a convection oven). Alternatively, curing may be effected by air in a process of air curing.

In one embodiment, a coating mixture comprises a matting agent in an amount of approximately 20 to 100 grams of matting agent per litre of coating mixture, for example approximately 40 to 80 grams per litre, or approximately 50 to 70 grams per litre. In one embodiment, the coating mixture comprises a matting agent in an amount of approximately 60 grams per litre.

Reference herein to "a liquid or a solid food" embraces any item that a mammal (e.g. a human) might drink or eat. Said item may have any (including zero) calorific value.

Reference herein to "an inner surface that defines a volume for receiving a liquid or a solid food" embraces any structure that is capable of supporting a liquid or a solid food item. Said structure may include plates and plate-like articles of manufacture (whether flat or curved in vertical cross-section), and bowls or bowl-like articles of manufacture (whether capable of retaining liquid or not).

The term "supports" as used in this context simply indicates that a polymeric coating has been applied to the outer (and/or inner) surface of the vessel. Thus, the polymeric coating may directly contact the outer (and/or inner) surface and/or may be separated therefrom by one or more intervening layers/coatings.

In one aspect the invention provides an apparatus for decorating a drinking or eating vessel, said apparatus comprising:

a. a supporting means comprising a recess for receiving a drinking or eating vessel; and/or
b. a vacuum means, wherein the vacuum means is capable of generating at least a partial vacuum for transferring a printed decoration from a transfer sheet to the surface of a drinking or eating vessel.

In one embodiment the apparatus comprises:

a. a supporting means comprising a recess for receiving a drinking or eating vessel; and
b. a vacuum means, wherein the vacuum means is capable of generating at least a partial vacuum for transferring a printed decoration from a transfer sheet to the surface of a drinking or eating vessel.

In one embodiment an apparatus comprises a drinking or eating vessel comprising an inner surface that defines a volume for receiving a liquid or a solid food and an outer surface comprising a polymeric coating, wherein the drinking or eating vessel is arranged within the recess of the supporting means.

The apparatus may further comprise one or more of a transfer sheet, a stopping means, and a barrier means described herein. A transfer sheet, stopping means or barrier means may be arranged as described herein.

The apparatus may further comprise heating means to facilitate transfer.

In some embodiments the vacuum means and heating means may be part of a vacuum oven, such as a vacuum oven described herein. Thus, in one embodiment the apparatus comprises a supporting means and/or a vacuum oven. The supporting means may be suitably arranged within the vacuum oven.

In some embodiments the recess of the supporting means is configured for receiving a drinking or eating vessel.

In one embodiment a supporting means provides a surface of the apparatus for arranging a drinking or eating vessel. In one embodiment the supporting means is arranged so that when the at least partial vacuum is generated, the supporting means supports a drinking or eating vessel against the directional force of the vacuum. For example, if the vacuum means is arranged at the lower portion of an apparatus (in use) or generates at least a partial vacuum with a downwards directional force, the supporting means is arranged above the vacuum means or source of the at least partial vacuum, and any drinking or eating vessel is arranged above the supporting means (i.e. within a recess thereof). The skilled person will appreciate that other in use arrangements may also be relevant, e.g. based on directional force of the at least partial vacuum.

The embodiments above in respect of a method or use of the invention can be applied to the apparatus described herein, and vice versa.

This disclosure is not limited by the exemplary methods and materials disclosed herein, and any methods and materials similar or equivalent to those described herein can be used in the practice or testing of embodiments of this disclosure. Numeric ranges are inclusive of the numbers defining the range. The headings provided herein are not limitations of the various aspects or embodiments of this disclosure.

Other definitions of terms may appear throughout the specification. Before the exemplary embodiments are described in more detail, it is to be understood that this disclosure is not limited to particular embodiments described, and as such may vary. It is also to be understood that the terminology used herein is for the purpose of describing particular embodiments only, and is not intended to be limiting, since the scope of the present disclosure will be defined only by the appended claims. Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within this disclosure. The upper and lower limits of these smaller ranges may independently be included or excluded in the range, and each range where either, neither or both limits are included in the smaller ranges is also encompassed within this disclosure, subject to any specifically excluded limit in the stated range. Where the stated range includes one or both of the limits, ranges excluding either or both of those included limits are also included in this disclosure.

It must be noted that as used herein and in the appended claims, the singular forms "a", "an", and "the" include plural referents unless the context clearly dictates otherwise. Thus, for example, reference to "a drinking or eating vessel" includes a plurality of such candidate agents and reference to "the drinking or eating vessel" includes reference to one or more drinking or eating vessels and equivalents thereof known to those skilled in the art, and so forth.

The publications discussed herein are provided solely for their disclosure prior to the filing date of the present application. Nothing herein is to be construed as an admission that such publications constitute prior art to the claims appended hereto.

FIGURES

Embodiments of the invention will now be described, by way of example only, with reference to the following Figures and Examples.

FIG. 1 shows a process flowchart for decorating a drinking vessel (e.g. a mug).

Figure 2:
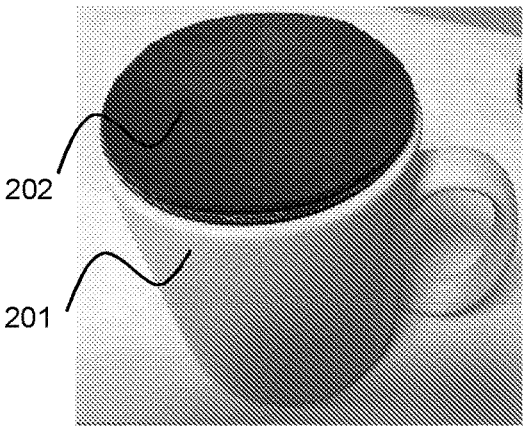
FIG. 2 (A) shows a drinking vessel (mug) (201) and a two-piece stopping means (202). (B) shows four apertures (203) and a larger central aperture (204) of said stopping means. (C) shows the underside of stopping means (202) having a silicone disc (205) with four apertures (203) and a larger central aperture (204) affixed to metal disc (206).
Figure 2:
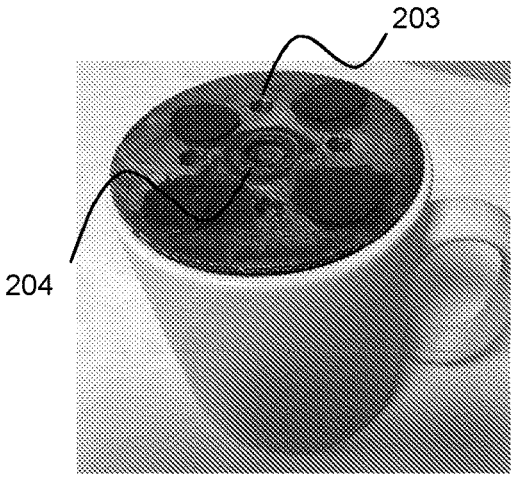
Figure 2:
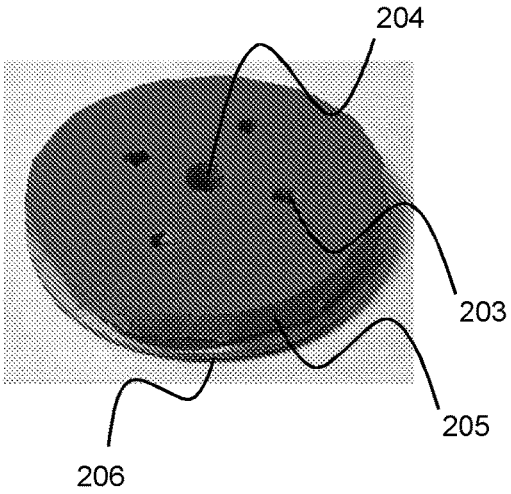

FIG. 2 (A) shows a drinking vessel (mug) (201) and a two-piece stopping means (202). (B) shows four apertures (203) and a larger central aperture (204) of said stopping means. (C) shows the underside of stopping means (202) having a silicone disc (205) with four apertures (203) and a larger central aperture (204) affixed to metal disc (206).

Figure 3:
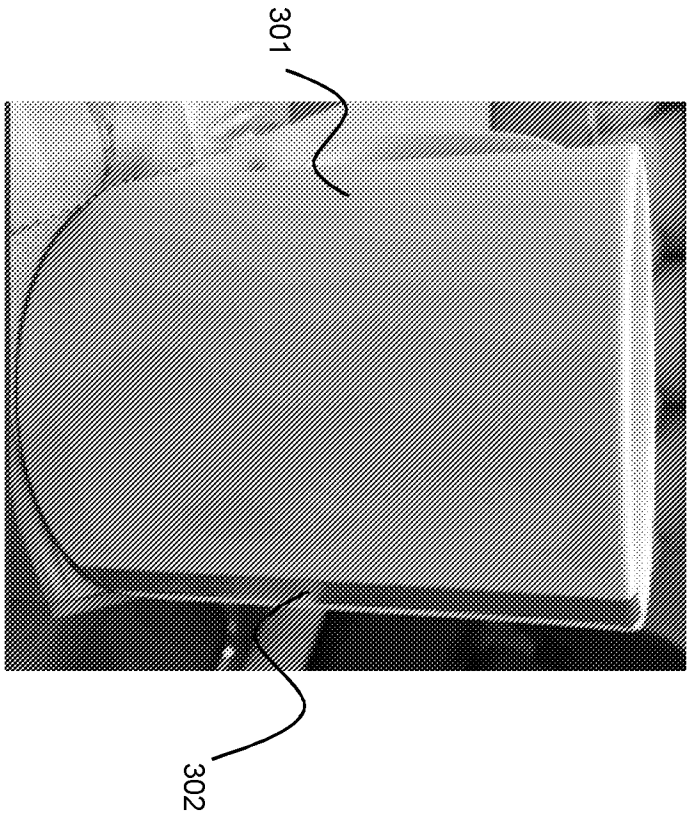
FIG. 3 shows the positioning of heat resistant transfer tape (302) on a drinking vessel (301) to define a non-print area.

FIG. 3 shows the positioning of heat resistant transfer tape (302) on a drinking vessel (301) to define a non-print area.

Figure 4:
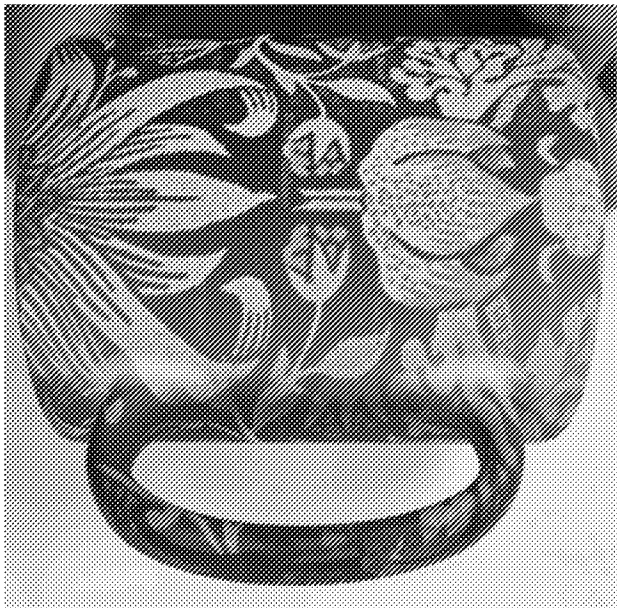
FIG. 4 (A) shows the decoration quality obtained using a Caseblanks transfer sheet printed using Sublijet HD dye sublimation inks (CMYK) on the Ricoh SG800 inkjet printer. (B) shows the decoration quality obtained using a SMI transfer sheet printed using SubliM Dye Sublimation inks (CMYK) using the Mimaki® JV33 inkjet printer.
Figure 4:
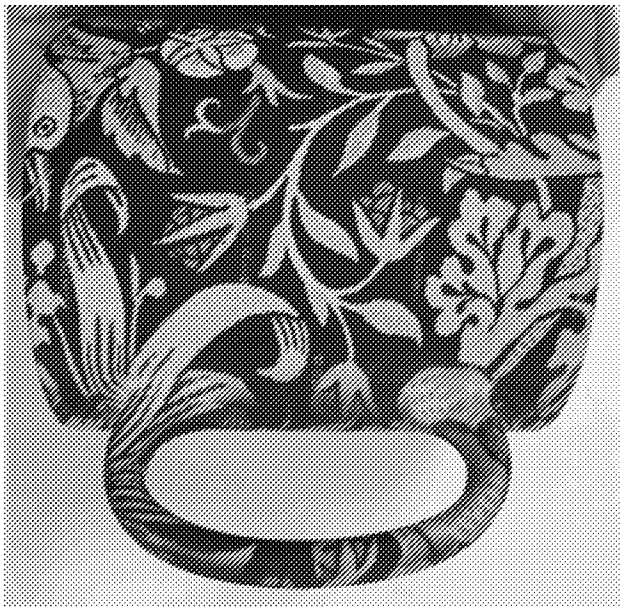

FIG. 4 (A) shows the decoration quality obtained using a Caseblanks transfer sheet printed using Sublijet HD dye sublimation inks (CMYK) on the Ricoh SG800 inkjet printer. (B) shows the decoration quality obtained using a SMI transfer sheet printed using SubliM Dye Sublimation inks (CMYK) using the Mimaki® JV33 inkjet printer.

Figure 5:
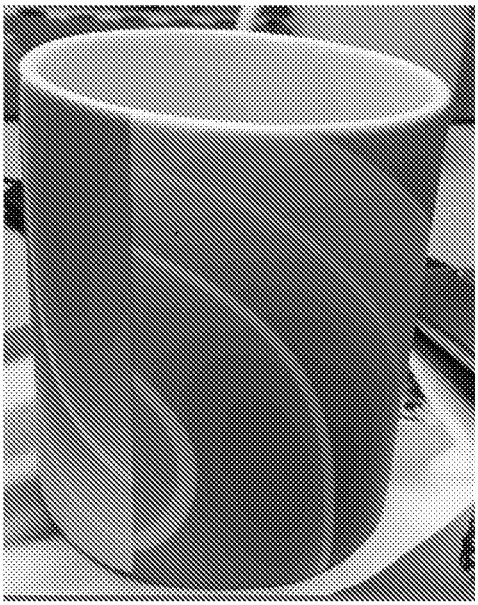
FIG. 5 shows a drinking vessel decorated using a method of the present invention. In more detail: (A) shows decoration on the outer surface of the drinking vessel; (B) shows decoration at the handle and the outer surface facing said handle; and (C) shows decoration at the base of the drinking vessel.
Figure 5:
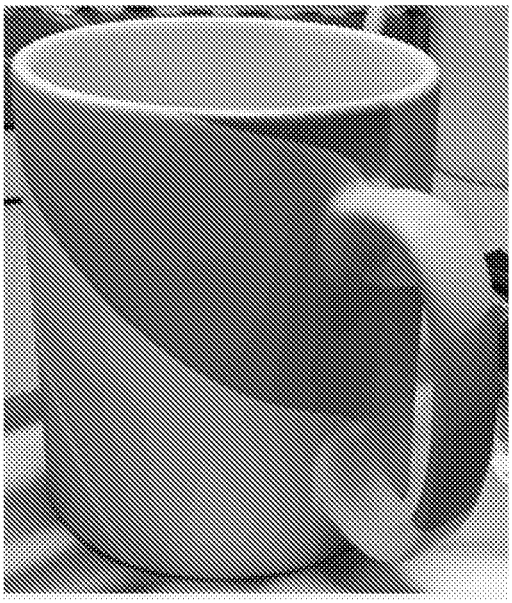
Figure 5:
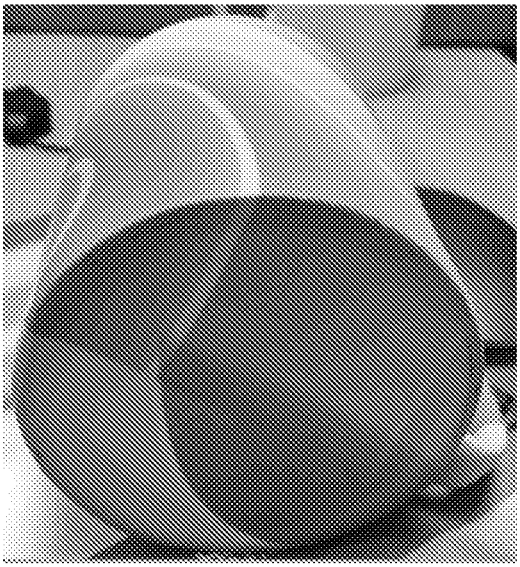

FIG. 5 shows a drinking vessel decorated using a method of the present invention. In more detail: (A) shows decoration on the outer surface of the drinking vessel; (B) shows decoration at the handle and the outer surface facing said handle; and (C) shows decoration at the base of the drinking vessel.

Figure 6:
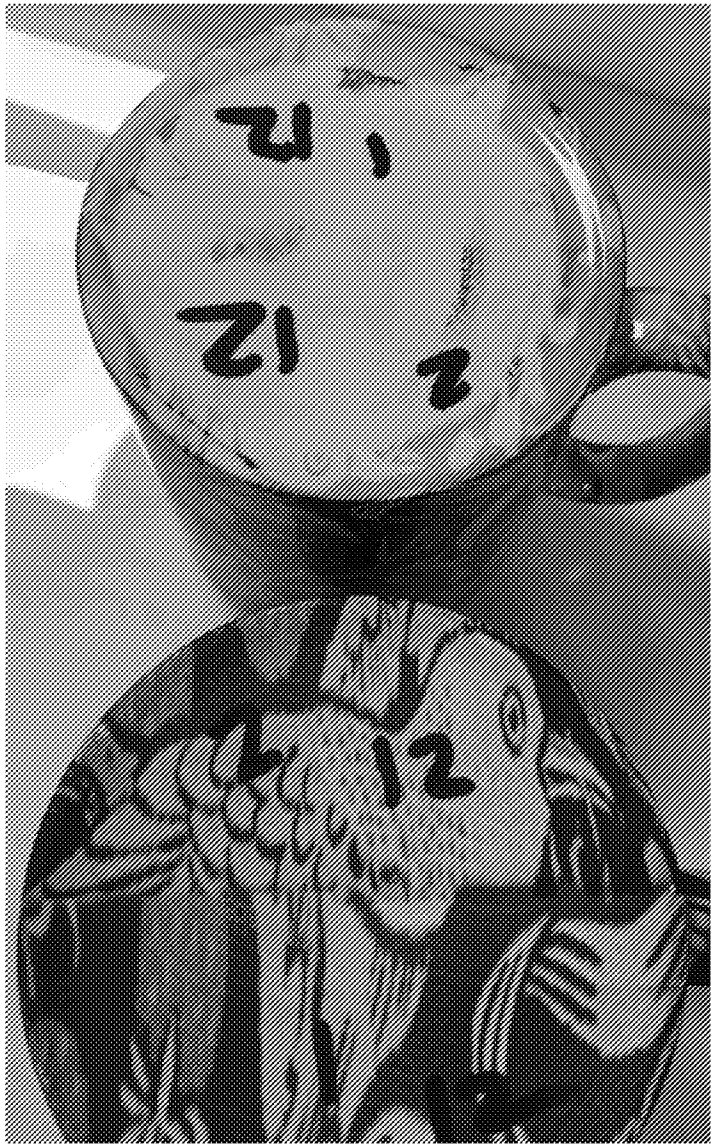
FIG. 6 shows printed decoration transfer at: (A) the base (compare the matt-finished Neogene Satin mug (right) to the DuraGlaze™ gloss coated mug (left)); (B) the upper handle (compare the matt-finished Neogene Satin mug (lower, left) to the DuraGlaze™ gloss coated mug (upper, right)); (C) the lower handle (compare the matt-finished Neogene Satin mug (right) to the DuraGlaze™ gloss coated mug (left)); and (D) the inside of the handle (compare the matt-finished Neogene Satin mug (lower) to the DuraGlaze™ gloss coated mug (upper)).
Figure 6:
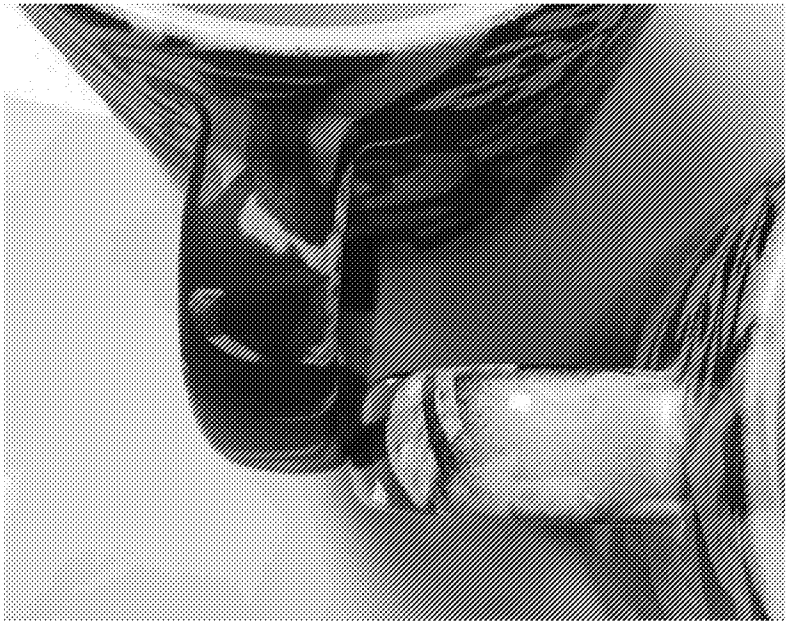
Figure 6:
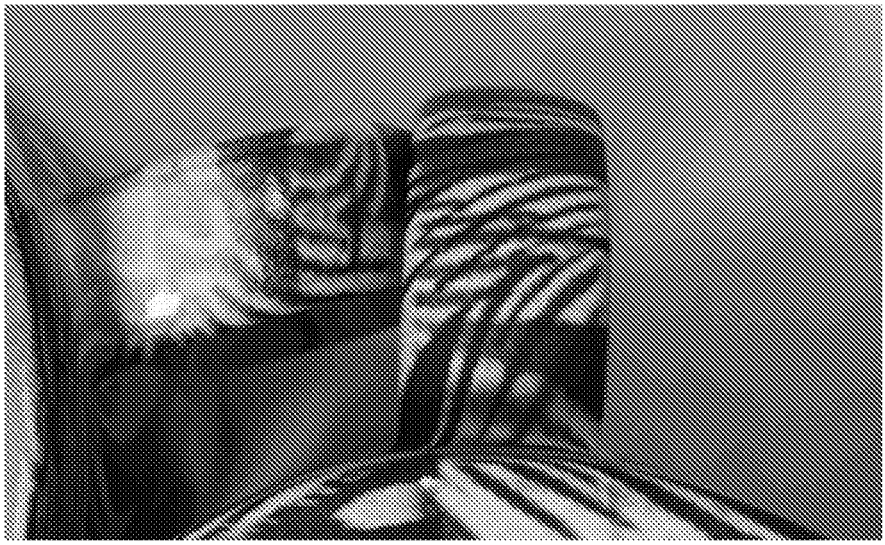
Figure 6:
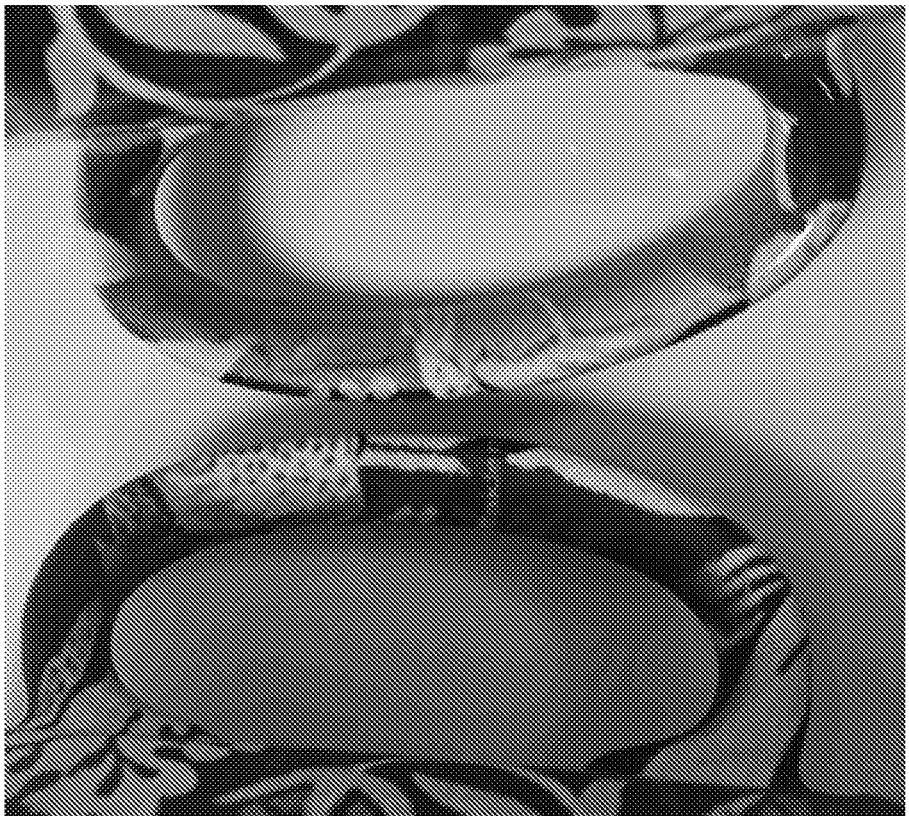

FIG. 6 shows printed decoration transfer at: (A) the base (compare the matt-finished Neogene Satin mug (right) to the DuraGlaze™ gloss coated mug (left)); (B) the upper handle (compare the matt-finished Neogene Satin mug (lower, left) to the DuraGlaze™ gloss coated mug (upper, right)); (C) the lower handle (compare the matt-finished Neogene Satin mug (right) to the DuraGlaze™ gloss coated mug (left)); and (D) the inside of the handle (compare the matt-finished Neogene Satin mug (lower) to the DuraGlaze™ gloss coated mug (upper)).

FIG. 7 illustrates an apparatus, 700, including a supporting means, 702 having a recess. The drinking or eating vessel, 704 may be positioned in the recess. The transfer sheet, 706 is applied to the drinking or eating vessel, 704 and transfers a decoration to the drinking or eating vessel, 704. The vacuum means, 710 applies suction. The supporting means, 702 may optionally include a cushioning means, 708. The cushioning means, 708 may form a gasket at the interface between an outer and inner surface of the recess of the supporting means, 702.

EXAMPLES

Materials & Methods

Equipment Used:

V10 vacuum oven (available from Shenzhen Caseblanks Technology Co., Ltd, A-3rd Floor, Junfeng Innovation Technology Park, Chongqing Rd, Fuyong Town, Baoan District, 518103, Shenzhen, Guangdong, China).

Inkjet Printer (either Ricoh SG800 (Virtuoso® SG800—available from Sawgrass Europe, Jubilee House, Hillsborough, Sheffield, S6 1LZ, United Kingdom) or Mimaki® JV33—available from Mimaki® Global, 2182-3 Shigeno-Otsu, Tomi-city, Nagano, Japan).

To facilitate forming around the complex shape of a drinking vessel (i.e. a mug) a formable PET transfer sheet was used in place of a standard transfer paper. PET films coated for printing using an Inkjet machine were used:

Caseblanks white film (170 micron) commercially available from Shenzhen Caseblanks Technology Co., Ltd, A-3rd Floor, Junfeng Innovation Technology Park, Chongqing Rd, Fuyong Town, Baoan District, 518103, Shenzhen, Guangdong, China.

SMI technology 3D silver-backed film (270 micron) commercially available from SMI Coated Products Private Limited, 11-B-2, Gundecha Onclave, Kherani Road, Sakinaka, Andheri East, Mumbai 400 072, India.

Technotape silver film 'Xtreme 3D film' (270 micron) commercially available from Technotape, Tolweg 7, Baarn, 3741LM, Holland.

Mugs were decorated using a modified vacuum sublimation method as summarised in the process flowchart of FIG. 1. In more detail mugs were pre-warmed to operating temperature (150° C.) to reduce overall processing time in the press and the transfer sheet (film) pre-heated for 10 seconds before vacuum engaged to soften prior to forming.

A mug was placed on its side in the recess of a supporting means (a false base) which reduced the extent the film needs to form around the body. The edge of the supporting means (a false base) was sealed using silicone sealer and a silicone rubber gasket to prevent the transfer sheet being pulled down around the edges and over-stressing the material. Apertures within the supporting means (false base) were provided for allowing formation and maintenance of the vacuum (e.g. in proximity to key process areas where the film may struggle to form i.e., around handle and handle join, close to the mug apertures, etc.) and silicone gaskets were applied around said apertures. The underside of the mug was cushioned with silicone rubber padding (in the recess of the supporting means) to reduce stress through physical pressure on the mug body.

The aperture of the recess of the supporting means (the false metal base) was larger than the mug to prevent expansion during the heat cycle and crushing of the mug, and a silicone rubber gasket was used to create a seal around the enlarged aperture.

A stopping means was inserted into the volume of the mug to prevent the transfer sheet from being pulled into the inside and over-stressing the material (see FIG. 2). Holes were provided at 4 points of the compass and centre of the stopping means to allow the air pressure inside and outside of the mug to balance once the vacuum was fully created.

Blue heat resistant tape (302) was used to mask a clean line down the middle of the mug (301) opposite the handle before running the first transfer cycle (FIG. 3). The tape creates a barrier preventing the mug being decorated where it has been applied.

A transfer sheet with a printed decoration was placed over the mug and supporting means, and a second PET sheet (100 microns) applied over the transfer sheet and a vacuum of between −0.7 bar to −0.8 bar was applied. Transfer was carried out at a temperature of 150° C. for 8 to 15 minutes in a V10 vacuum oven.

The mug was removed, the heat resistant tape removed (the tape helps alignment between both print stages (i.e. to avoid unsightly areas of double print, or no print at all)), a second piece of tape positioned and repositioned against the very edge of the first printed side between transfer cycles to ensure a bleed of no more than 1 mm, and the undecorated portion presented face up on the stopping means. A second transfer sheet with a printed decoration was placed over the mug and supporting means, and a second PET sheet applied over the transfer sheet and the transfer repeated.

Example 1

Transfer was carried out using a method described above with a transfer time of 8-9 minutes.

SMI transfer sheets printed with SubliM Dye Sublimation inks (CMYK) using the Mimaki® JV33 exhibited improved release properties (FIG. 4(B)) when compared to Caseblanks white film transfer sheets printed with Sublijet-HD Dye Sublimation inks (CMYK) (all inks available from Sawgrass Europe, Jubilee House, Hillsborough, Sheffield, S6 1LZ, United Kingdom) using the Ricoh SG800 printer (FIG. 4(A)). Additionally, the SMI/SubliM Dye combination demonstrated consistent transfer with strong colour saturation.

Example 2

Transfer was carried out using the method described above using Caseblanks white film transfer sheets printed with Sublijet-HD Dye Sublimation inks (CMYK) on a Ricoh SG800 printer. Transfer time was 8-10 minutes.

A mug printed using a method of the invention is shown in FIG. 5, and exhibits good overall coverage.

Example 3

Different transfer times were tested to assess the impact on edge-to-edge consistency of the applied decoration.

Use of dye sublimation inks obtained from Sensient® Imaging Technologies (Z.I. Riond-Bosson 8, CH-1110, Morges 2, Switzerland) in combination with the Mimaki® JV33 printed exhibited good transfer.

Transfer time using said inks was tested at 12 to 14 minutes (12 showed satisfactory results) and such transfer times allowed a good level of ink transfer at the edges of the transfer sheet.

Trials indicated that decoration transfer to a drinking vessel using the SMI Technology transfer sheet was improved when compared to the Caseblanks transfer sheet, also drinking vessels decorated using the SMI Technology transfer sheet exhibited improved print edge-to-edge consistency.

Example 4

Mugs that have been manufactured using alternative polymeric coating techniques were subjected to a decorating method of the invention. SMI transfer sheets were printed with dye sublimation inks obtained from Sensient® Imaging Technologies printed using the Mimaki® JV33, and transfer occurred for 12 minutes.

Automated (robotic) techniques were used to apply polymeric coating to a matt-finished Neogene Satin mug. A chain on edge line was used to present the mugs to the spray position, and to transit them thereafter into the ovens. A 6-axis robot was used to move a pair of guns through a pre-programmed series of motions enabling the polymeric coating to be applied evenly to all outer surfaces of the mug.

The matt-finished (Neogene Satin) mugs were subjected to the decorating method described. Said mugs exhibited good transfer even on the base. Without wishing to be bound by theory, this was believed to be due to the production method yielding ~100% polymeric coating of the mug. The DuraGlaze™ gloss coated mugs were prepared by HVLP spraying on a rotating pedestal, thus certain areas of the mug (e.g. the base and inner handle) were less likely to be exposed to the same amount of polymeric coating as other parts of the outer surface. Thus, whilst exhibiting reasonable decoration transfer said mugs showed comparatively poorer decoration around the handle likely owing to the poorer quality finishing of the polymeric coating of the mugs at this portion of the surface.

FIG. 6 shows improved transfer at: (A) the base (compare the matt-finished Neogene Satin mug (right) to the DuraGlaze™ gloss coated mug (left)); (B) the upper handle (compare the matt-finished Neogene Satin mug (lower, left) to the DuraGlaze™ gloss coated mug (upper, right)); (C) the lower handle (compare the matt-finished Neogene Satin mug (right) to the DuraGlaze™ gloss coated mug (left)); and (D) the inside of the handle (compare the matt-finished Neogene Satin mug (lower) to the DuraGlaze™ gloss coated mug (upper)).

Notably, tests conducted using the DuraGlaze™ gloss coated mugs where the polymeric coating was applied as per the matt-finished Neogene Satin mugs (i.e. using the chain on edge line and 6-axis robot) exhibited similar advantageous decoration transfer.

All publications mentioned in the above specification are herein incorporated by reference. Various modifications and variations of the described methods and system of the present invention will be apparent to those skilled in the art without departing from the scope and spirit of the present invention. Although the present invention has been described in connection with specific preferred embodiments, it should be understood that the invention as claimed should not be unduly limited to such specific embodiments. Indeed, various modifications of the described modes for carrying out the invention which are obvious to those skilled in manufacturing (e.g. of ceramics) and/or decorating and/or printing techniques or related fields are intended to be within the scope of the following claims.

The invention claimed is:

1. A method for decorating a drinking or eating vessel, the method comprising:

a. providing:
   i. a drinking or eating vessel, wherein the vessel comprises an inner surface that defines a volume for receiving a liquid or a solid food and an outer surface comprising a polymeric coating; and
   ii. a transfer sheet, wherein the transfer sheet is a formable plastic transfer sheet and comprises a printed decoration; and
   iii. a supporting means comprising a recess for receiving the vessel; and
b. arranging the vessel within the recess of the supporting means thereby defining a lower portion of the outer surface of the vessel occluded from contact with the transfer sheet and an upper portion of the outer surface of the vessel for contacting the transfer sheet; and
c. contacting the upper portion of the outer surface of the vessel and the supporting means with the transfer sheet under at least a partial vacuum, wherein the printed decoration is transferred from the transfer sheet to the upper portion of the outer surface of the vessel, and wherein the supporting means reduces stretching of the transfer sheet from the upper portion of the outer surface of the vessel to the lower portion of the outer surface of the vessel.

2. The method of claim 1, wherein the transfer sheet is a polyethylene terephalate (PET) transfer sheet.

3. The method of claim 1, wherein during contacting a stopping means is arranged to occlude at least a portion of the volume defined by the inner surface of the vessel.

4. The method of claim 3, wherein the stopping means comprises one or more aperture(s).

5. The method of claim 1, wherein the supporting means comprises cushioning means.

6. The method of claim 5, wherein the cushioning means forms a gasket at the interface between an outer and inner surface of the recess of the supporting means.

7. The method of claim 1, wherein the height of the lower portion occluded from contact with the transfer sheet is the same or less than the height of the upper portion.

8. The method of claim 1, wherein the contacting occurs at a temperature of between about 120° C. to about 210° C.

9. The method of claim 1, wherein the contacting occurs at a temperature of between about 120° C. to about 190° C.

10. The method of claim 1, wherein the contacting occurs at a temperature of between about 130° C. to about 170° C.

11. The method of claim 1, wherein the polymeric coating of the drinking or eating vessel comprises a matting agent.

12. The method of claim 1, wherein the transfer sheet is allowed to dry following printing of decoration onto said transfer sheet.

13. The method of claim 1, further comprising re-arranging the vessel within the recess of the supporting means thereby defining a different lower and upper portion of the vessel, and repeating step c. using a second transfer sheet comprising a printed decoration.

14. The method of claim 1, wherein prior to contacting, a barrier means is applied to the drinking or eating vessel defining a non-print area.

15. The method of claim 14, wherein the barrier means is a tape.

16. The method of claim 14, wherein the barrier means is removed prior to carrying out a second transfer step.

17. The method of claim 16, wherein a second barrier means is applied prior to carrying out the second transfer step.

18. A drinking or eating vessel obtainable by the method of claim 1, wherein the vessel comprises an inner surface that defines a volume for receiving a liquid or solid food and an outer surface comprising a polymeric coating, wherein:

at least 80% of the total outer surface of the vessel comprises printed decoration and the printed decoration forms a diffuse layer within the polymeric coating.

19. The drinking or eating vessel of claim 18, characterised in that said vessel comprises a base comprising printed decoration.

20. An apparatus for decorating a drinking or eating vessel, said apparatus comprising:

a. a supporting means comprising a recess for receiving a drinking or eating vessel;

b. a vacuum means, wherein the vacuum means is capable of generating at least a partial vacuum for transferring a printed decoration from a transfer sheet to the surface of a drinking or eating vessel, c. a drinking or eating vessel comprising an inner surface that defines a volume for receiving a liquid or a solid food and an outer surface comprising a polymeric coating, wherein the drinking or eating vessel is arranged within the recess of the supporting means, and d. a transfer sheet, wherein the transfer sheet is a formable plastic transfer sheet and comprises a printed decoration, and wherein the arrangement of the vessel within the recess of the supporting means defines a lower portion of the outer surface of the vessel occluded from contact with the transfer sheet and an upper portion of the outer surface of the vessel for contacting the transfer sheet, and wherein said transfer sheet is in contact with the upper portion of the outer surface of the vessel.

* * * * *